US012617590B2

(12) United States Patent
Luo

(10) Patent No.: US 12,617,590 B2
(45) Date of Patent: May 5, 2026

(54) WATER CUPS WITH DETACHABLE CUP LIDS

(71) Applicants: SHENZHEN CREAL CREATIVE TECHNOLOGY CO., LTD, Shenzhen (CN); DEDEDIS LIMITED, Hong Kong (HK)

(72) Inventor: Bing Luo, Shenzhen (CN)

(73) Assignees: SHENZHEN CREAL CREATIVE TECHNOLOGY CO., LTD, Shenzhen (CN); DEDEDIS LIMITED, Hong Kong (HK)

( * ) Notice: Subject to any disclaimer, the term of this patent is extended or adjusted under 35 U.S.C. 154(b) by 0 days.

(21) Appl. No.: 19/340,788

(22) Filed: Sep. 25, 2025

(65) Prior Publication Data

US 2026/0091914 A1 Apr. 2, 2026

(30) Foreign Application Priority Data

Sep. 30, 2024 (CN) ..... 202422401592.X

(51) Int. Cl.

| | |
|---|---|
| ***A45F 3/18*** | (2006.01) |
| ***A47G 19/22*** | (2006.01) |
| ***B65D 47/06*** | (2006.01) |
| ***B65D 51/24*** | (2006.01) |

(52) U.S. Cl.

CPC ..... *B65D 47/066* (2013.01); *A45F 3/18* (2013.01); *A47G 19/2222* (2013.01); *A47G 19/2272* (2013.01); *B65D 51/242* (2013.01)

(58) Field of Classification Search

CPC .... A45F 3/18; A47G 19/2272; B65D 47/2043
See application file for complete search history.

(56) References Cited

U.S. PATENT DOCUMENTS 5,361,934 A * 11/1994 Spence, Jr. ..... B65D 47/2043 220/709
8,191,727 B2 * 6/2012 Davies ..... B65D 51/242 220/709

FOREIGN PATENT DOCUMENTS

DE 102014019509 A1 * 6/2016 ..... A45F 3/16

OTHER PUBLICATIONS

Translation of DE-102014019509-A1 (Year: 2016).*

* cited by examiner

*Primary Examiner* — Mollie Impink
(74) *Attorney, Agent, or Firm* — PORUS IP LLC

(57) ABSTRACT

The present disclosure relates to a water cup. The water cup includes a cup body and a cup lid detachably connected to the cup body. The cup lid includes a drinking component and a dustproof component. The drinking component includes a base and a straw mouthpiece. The base is provided with a first straw through-hole. The straw mouthpiece is connected to the base via a movable component. The base is provided with two first grooves. The two first grooves are symmetrically arranged along and with respect to a side wall of the first straw through-hole. The dustproof component includes a fixing member, a switching member, and a dustproof cover arranged in sequence from top to bottom along a height direction of the water cup. An inner side of the switching member is symmetrically provided with two first protrusions. The switching member is connected to the base.

14 Claims, 10 Drawing Sheets

WATER CUPS WITH DETACHABLE CUP LIDS

CROSS-REFERENCE TO RELATED APPLICATIONS

This application claims priority to Chinese application No. 202422401592.X, filed on Sep. 30, 2024, the entire contents of which are incorporated herein by reference.

TECHNICAL FIELD

The present disclosure relates to the field of daily-use water cups, and in particular, to a water cup with a detachable cup lid.

BACKGROUND

As far as the applicant knows, the cup lids of current water cups are typically not detachable or have limited detachability, making the cup lids hard to clean. This is especially true for regions such as the joints between the components of the cup lid and parts like rubber rings, which are not easily accessible for cleaning, leading to the accumulation of bacteria and dirt. After prolonged use, not only may unpleasant odors develop inside the cup lid, but the cup lid also poses a potential health risk to users. Furthermore, long-term inadequate cleaning may cause damage and functional failure of components of the cup lid, thereby affecting the normal use of the water cup and significantly reducing the service life of the water cup.

In addition, the non-detachable cup lid is inconvenient in terms of design and usability. The non-detachable cup lid is relatively tight, and it is difficult for the user with limited hand strength to open or close the cup lid with one hand, thus limiting the practical application of the water cup.

Therefore, it is desirable to provide a water cup with a detachable cup lid to solve the above problems.

SUMMARY

The present disclosure provides a water cup with a detachable cup lid. The water cup includes a cup body and a cup lid detachably connected to the cup body. The cup lid includes a drinking component and a dustproof component. The drinking component includes a base and a straw mouthpiece, the base is provided with a first straw through-hole, and the straw mouthpiece is connected to the base through a movable component. The base is provided with two first grooves, and the two first grooves are symmetrically arranged along and with respect to a side wall of the first straw through-hole. The dustproof component includes a fixing member, a switching member, and a dustproof cover arranged in sequence from top to bottom along a height direction of the water cup. An inner side of the switching member is symmetrically provided with two first protrusions, and the switching member is connected to the base via the two first protrusions and the two first grooves.

BRIEF DESCRIPTION OF THE DRAWINGS

The technical solution of the present disclosure is hereinafter described in further detail by means of the accompanying drawings and embodiments.

DETAILED DESCRIPTION

The technical solutions of the present disclosure are further described below by means of the accompanying drawings and embodiments.

Unless otherwise defined, technical terms or scientific terms used in the present disclosure should have the ordinary meaning as understood by a person of ordinary skill in the field to which the present disclosure belongs. The use of the terms "first," "second," and the like in this disclosure does not imply any order, quantity, or degree of accuracy. The terms "first," "second," and similar terms used in this disclosure do not indicate any order, quantity, or importance, but are used only to distinguish between different components. The words "include" or "comprises" and the like mean that the components or objects appearing before the word "includes" or "comprises" encompass the components or objects appearing before the word "includes" or "comprises." The preceding component or object encompasses the component or object that appears after the term and its equivalents, and does not exclude other components or objects. The terms "connected" or "connected" and the like are not limited to physical or mechanical connections. Physical or mechanical connections, but may include electrical connections, whether direct or indirect. "Up," "Down," "Left," "Right," etc., are only used to represent relative positional relationships, and when the absolute position of the object being described changes, the relative positional relationship may change accordingly.

Figure 1:
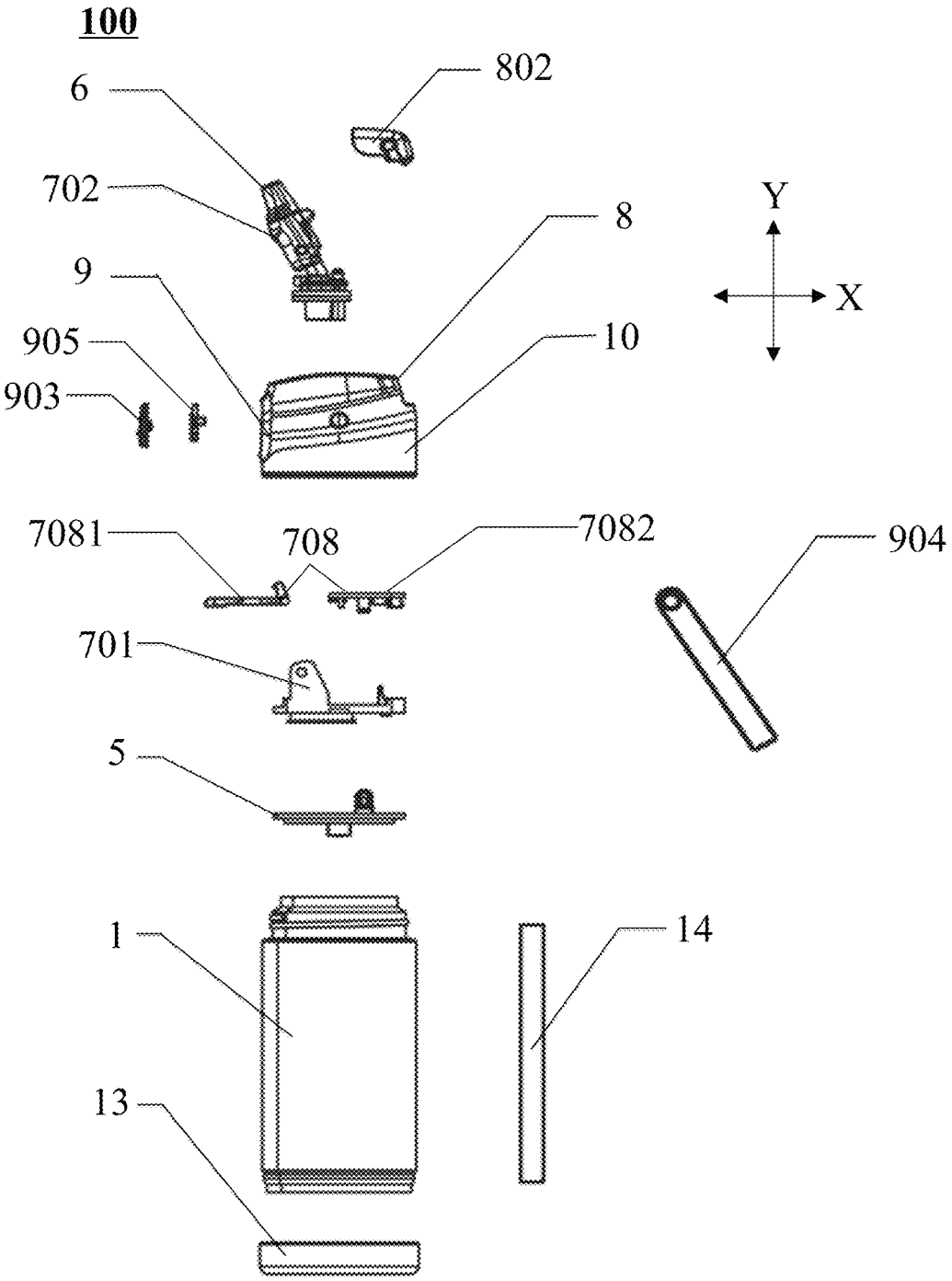
FIG. 1 is an exploded diagram of a structure of a water cup with a detachable cup lid according to some embodiments of the present disclosure.
Figure 2:
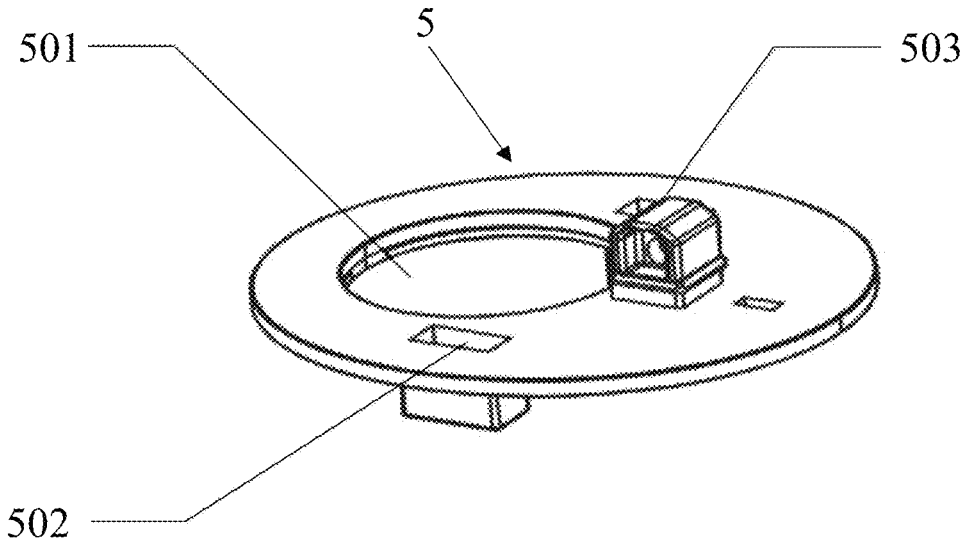
FIG. 2 is a structural diagram of a base of a water cup with a detachable cup lid according to some embodiments of the present disclosure.
Figure 3:
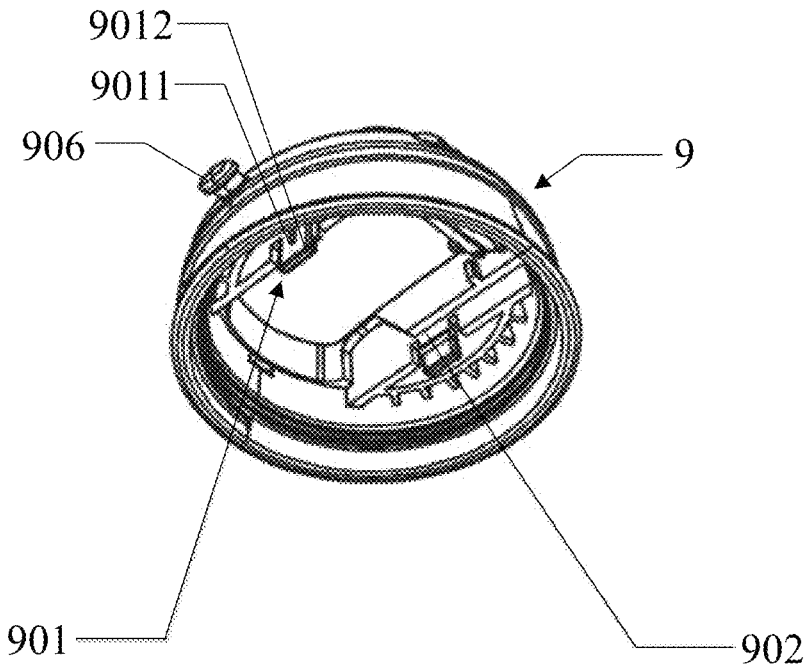
FIG. 3 is a structural diagram of a switching member of a water cup with a detachable cup lid according to some embodiments of the present disclosure.
Figure 4:
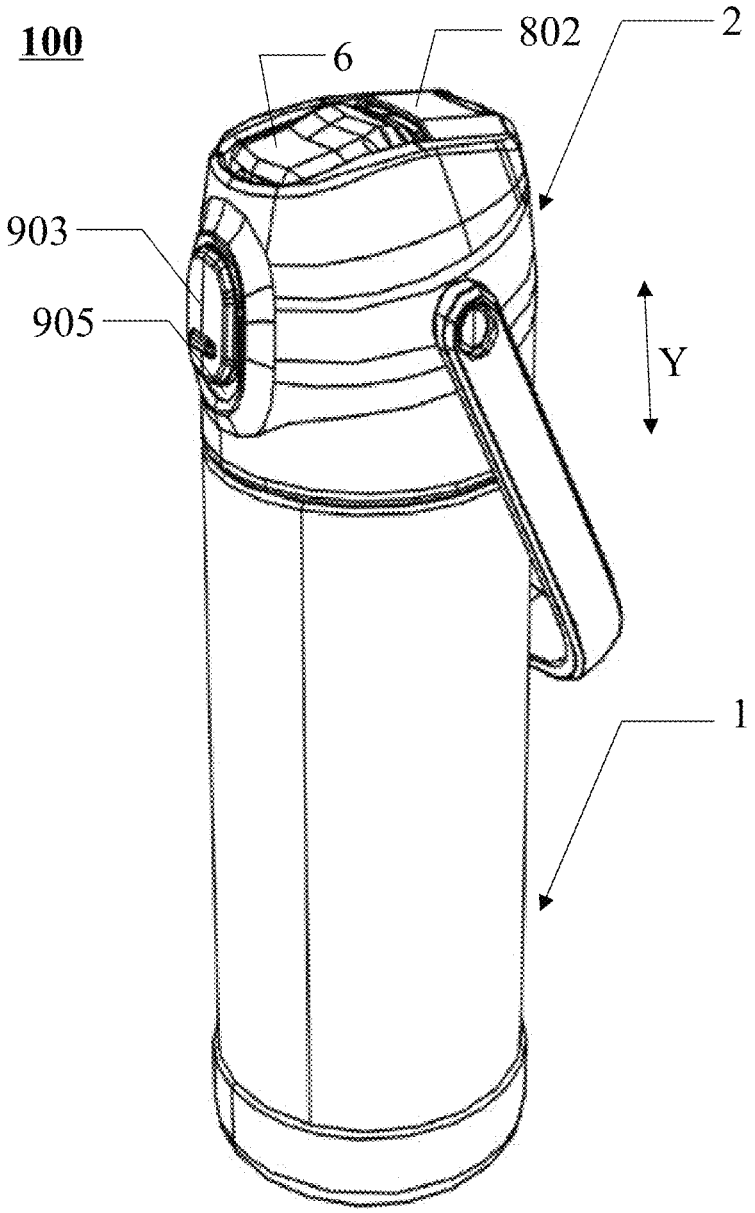
FIG. 4 is a schematic diagram of a water cup with a detachable cup lid in a closed state according to some embodiments of the present disclosure.
Figure 5:
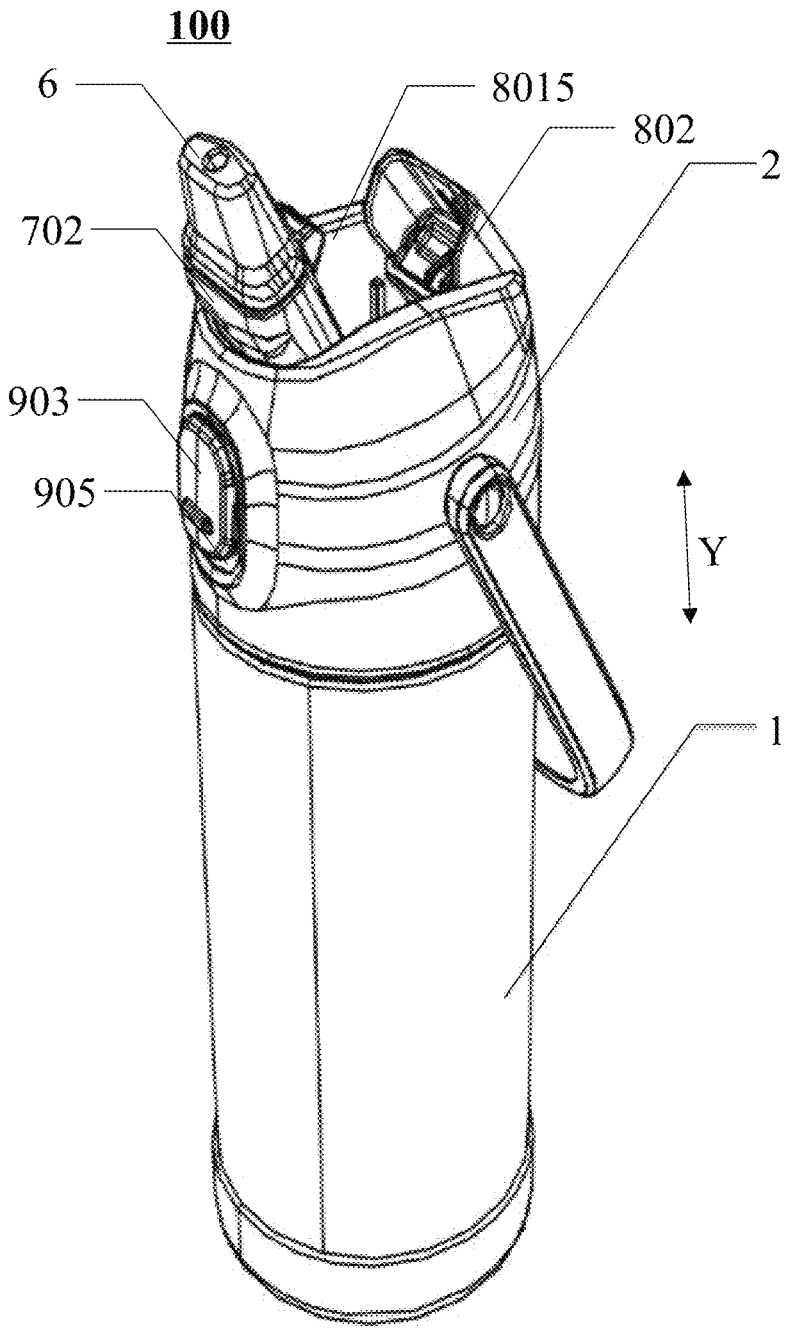
FIG. 5 is a schematic diagram of a water cup with a detachable cup lid in an open state according to some embodiments of the present disclosure.

FIG. 1 is an exploded diagram of a structure of a water cup with a detachable cup lid according to some embodiments of the present disclosure. FIG. 2 is a structural diagram of a base of a water cup with a detachable cup lid according to some embodiments of the present disclosure. FIG. 3 is a structural diagram of a switching member of a water cup with a detachable cup lid according to some embodiments of the present disclosure. FIG. 4 is a schematic diagram of a water cup with a detachable cup lid in a closed state according to some embodiments of the present disclosure. FIG. 5 is a schematic diagram of a water cup with a detachable cup lid in an open state according to some embodiments of the present disclosure.

As shown in FIG. 1 to FIG. 5, the present disclosure provides a water cup 100 with a detachable cup lid (also referred to as a water cup 100). In some embodiments, the water cup 100 includes a cup body 1 and a cup lid 2 disposed on the cup body 1, and the cup lid 2 is detachably connected to the cup body 1. The cup lid 2 includes a drinking component 3 and a dustproof component 4.

The drinking component 3 includes a base 5 and a straw mouthpiece 6. The straw mouthpiece 6 is connected to the base 5 via the movable component 7. The base 5 is provided with a first straw through-hole 501. The base 5 is provided with two first grooves 502, and the two first grooves 502 are symmetrically arranged along and with respect to a side wall of the first straw through-hole 501.

The dustproof component 4 includes a fixing member 8, a switching member 9, and a dustproof cover 10 arranged in sequence from top to bottom along a height direction of the water cup 100. An inner side of the switching member 9 is symmetrically provided with two first protrusions 901, the switching member 9 is connected to the base 5 via the two first protrusions 901 and the two first grooves 502.

The drinking component 3 refers to a component of the cup lid 2 used to provide a drinking channel, thereby realizing the drinking function. The dustproof component 4 refers to a component in the cup lid 2 used to protect the drinking component 3 from being contaminated by dust and foreign matter.

The base 5 refers to a component used to support the other structures of the cup lid 2. When the cup lid 2 is assembled, the base 5 may be served as a foundation base of the cup lid 2 to support the drinking component 3, the dustproof component 4, and the movable component 7. The straw mouthpiece 6 refers to a component that directly contacts the mouth of a user and provides water for the user.

The movable component 7 refers to a component for realizing the movement of the straw mouthpiece 6 relative to the base 5. After the cup lid 2 is assembled, the straw mouthpiece 6 may move relative to the cup lid 2 in a particular manner (e.g., the straw mouthpiece 6 may rotate relative to the cup lid 2 about a particular rotation axis). When the straw mouthpiece 6 is moved to a particular position (e.g., the position where the straw mouthpiece 6 is located shown in FIG. 5), the user can drink water through the straw mouthpiece 6, and at that time, the cup lid 2 is open. When the straw mouthpiece 6 is moved to another particular position (e.g., the position where the straw mouthpiece 6 is located shown in FIG. 4), the dustproof component 4 isolates the straw mouthpiece 6 from the external environment to prevent the straw mouthpiece 6 from being contaminated by the outside world. At this time, the cup lid 2 is closed. More descriptions regarding the movable component 7 and the opening and closing of the cup lid 2 may be found in the related descriptions below.

The first straw through-hole 501 refers to a structure that provides a channel for the straw 14 described below to enable the straw 14 to extend from the inside of the cup lid 2 into the cavity of the cup body 1, thereby establishing the drinking channel. More descriptions regarding the straw 14 and the drinking channel may be found in the related descriptions below.

The two first grooves 502 being symmetrically arranged along and with respect to the side wall of the first straw through-hole 501 refers that the two first grooves 502 are arranged on the side wall of the first straw through-hole 501 (e.g., the two first grooves 502 are arranged on an upper surface of the base 5 near the first straw through-hole 501) and the two first grooves 502 are symmetrical with respect to a center of the first straw through-hole 501. For example, when the first straw through-hole 501 is a circular hole, the center of the first straw through-hole 501 refers to the center of the circular hole of the first straw through-hole 501. As another example, when the first straw through-hole 501 is a square hole, the center of the first straw through-hole 501 refers to the intersection of two diagonal lines of the first straw through-hole 501.

The height direction of the water cup 100 may be indicated by the arrow Y in FIG. 1. The fixing member 8 refers to a component that stores the straw mouthpiece 6 and prevents the straw mouthpiece 6 from being contaminated when the cup lid 2 is closed. As shown in FIG. 5, when the cup lid 2 is opened, the straw mouthpiece 6 protrudes from the fixing member 8, and the user can drink water using the straw mouthpiece 6. As shown in FIG. 4, when the cup lid 2 is closed, the straw mouthpiece 6 is stored in the fixing member 8 (e.g., an accommodation cavity 8015 of a U-shaped shell 801 hereinafter) and is protected from dust by the fixing member 8 (e.g., a protective cover 802 of the fixing member 8 hereinafter). More descriptions regarding the fixing member 8 may be found in the related descriptions below.

The switching member 9 refers to a member controlled by the user to open or close the cup lid 2. The switching member 9 includes a locked state and an unlocked state. When the switching member 9 is in the locked state, the cup lid 2 is in the closed state and cannot be opened. When the switching member 9 is in the unlocked state, the user can open the cup lid 2 to drink water through the switching member 9. More descriptions regarding the switching member 9 may be found in the related descriptions below.

The inner side of the switching member 9 refers to an interior of the switching member 9. For example, the switching member 9 is substantially a hollow columnar body, the two first protrusions 901 are provided on the inner side wall of the switching member 9, an upper end of the switching member 9 is connected to the fixing member 8, and a lower end of the switching member 9 is connected to the cup body 1. The two first protrusions 901 are symmetrical with respect to a center axis of the switching member 9.

When mounting the drinking component 3 and the dustproof component 4, the switching member 9 is placed above the base 5, and the switching member 9 and the base 5 are connected through the cooperation between the first protrusions 901 and the first grooves 502 (i.e., the two first protrusions 901 extend into the different first grooves 502 respectively).

The dustproof cover 10 refers to a component that seals and dust-proofs the connection position between the cup lid 2 and the cup body 1.

In this embodiment, the cup lid 2 is divided into the drinking component 3 and the dustproof component 4, which are quickly disassembled and assembled through the snap-fit connection between the first groove 502 and the first protrusion 901. The components of the cup lid 2 can be separated for cleaning, avoiding unsanitary corners of an integrated cup lid. In addition, the snap-fit connection of the first groove 502 and the first protrusion 901 enables the user to remove the cup lid 2 by hand, which significantly reduces the cleaning difficulty.

In some embodiments, when the two first protrusions 901 are engaged with the two first grooves 502, the drinking component 3 is fixed with the dustproof component 4. When the two first protrusions 901 are separated from the two first grooves 502, the drinking component 3 and the dustproof component 4 are detachable.

In some embodiments, both the two first protrusions 901 include a connection portion 9011 and a snap hook 9012. One end of the connection portion 9011 is connected to the switching member 9, and another end of the connection portion 9011 is connected to the snap hook 9012. Both the first grooves 502 include a slot that matches the snap hook 9012. When mounting the switching member 9 and the base 5, the two first protrusions 901 may be respectively inserted into the different first grooves 502, and the snap hooks 9012 of the two first protrusions 901 may be respectively inserted into the slots of the different first grooves 502. The base 5 and the switching member 9 are fixed through the cooperation between the snap hooks 9012 and the slots, thereby achieving the fixation between the drinking component 3 and the dustproof component 4.

It should be understood that the above embodiments are for exemplary illustration only, and do not limit the specific connection manners between the first protrusions 901 and the first grooves 502. In addition to the snap-fit connection manner, the switching member 9 and the base 5 may also be connected in other feasible ways. For example, the two first protrusions 901 may be magnetic members (e.g., magnets), and the two first grooves 502 are also provided with magnetic members. Thus, the first protrusions 901 and the first grooves 502 may also be firmly connected by the magnetic attraction between the magnetic members.

In this embodiment, by detachably connecting the drinking component 3 and the dustproof component 4 through the cooperation between the first protrusion 901 and the first groove 502, a detachable range of the cup lid 2 is larger, so that the cleaning of the cup lid 2 is more convenient. By disassembling the cup lid 2 into the drinking component 3 and the dustproof component 4, the drinking component 3 and the dustproof component 4 can be easily and thoroughly cleaned, thereby avoiding the growth of bacteria and dirt, which extends the service life of the water cup 100 while ensuring hygiene and health.

Figure 6:
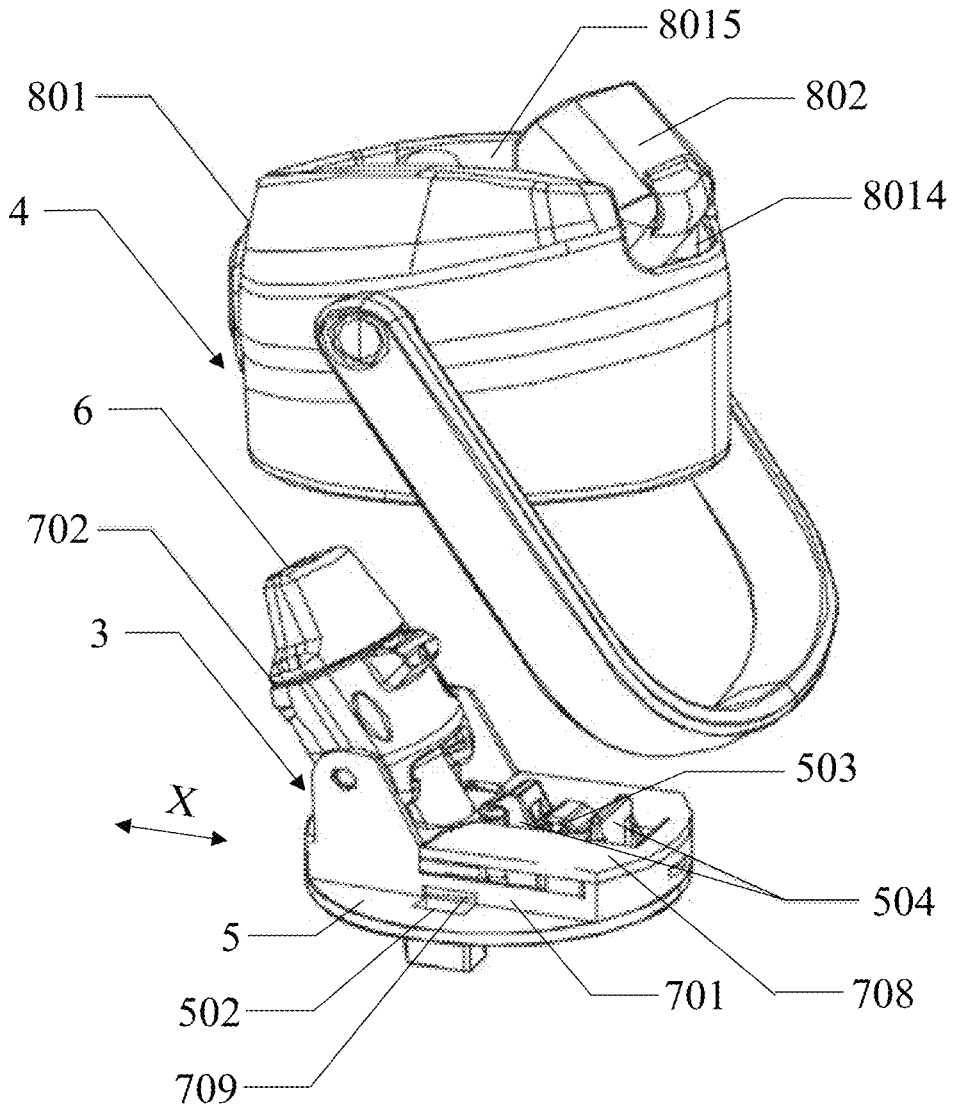
FIG. 6 is a disassembled diagram of a structure of a cup lid of a water cup with a detachable cup lid according to some embodiments of the present disclosure.
Figure 7:
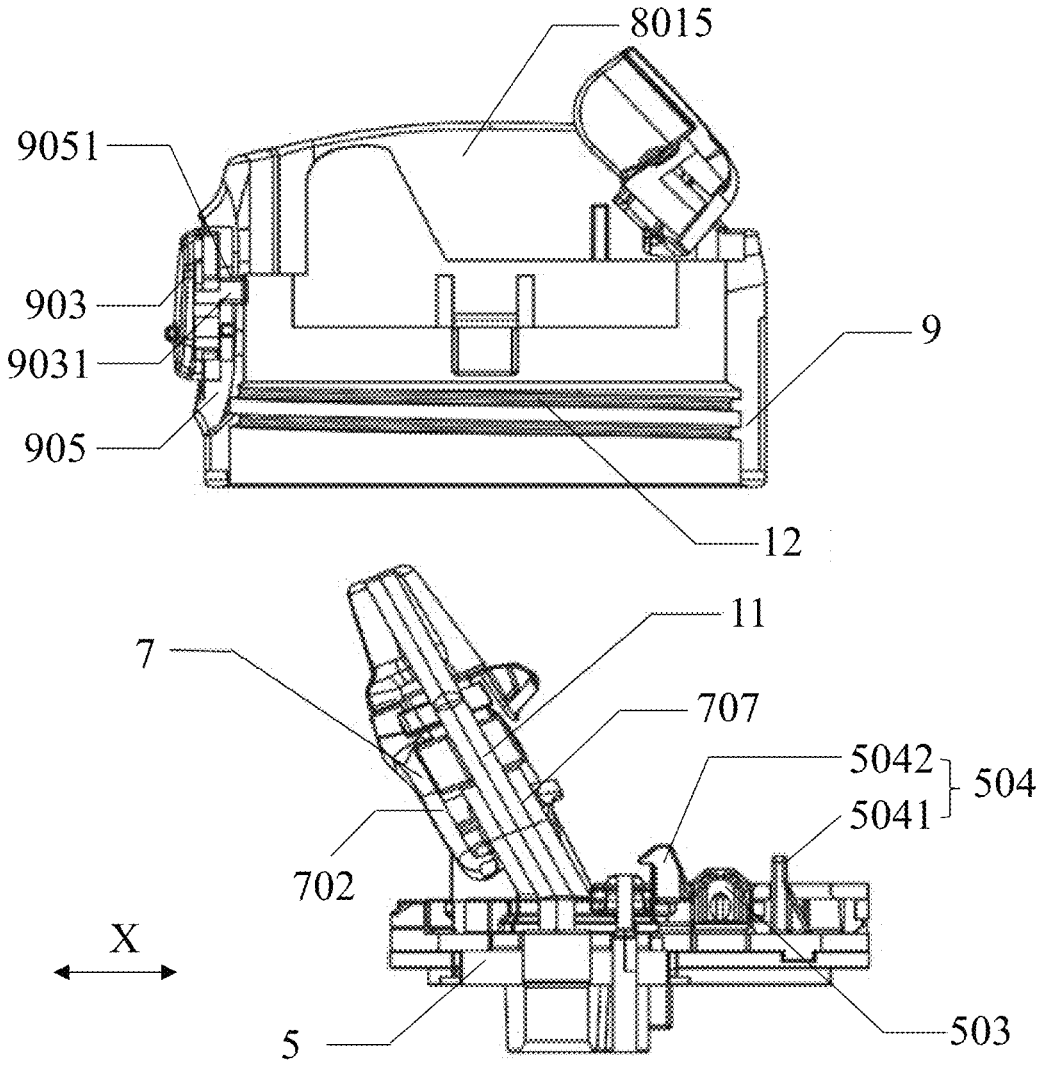
FIG. 7 is a side sectional view of a cup lid of a water cup with a detachable cup lid according to some embodiments of the present disclosure.
Figure 8:
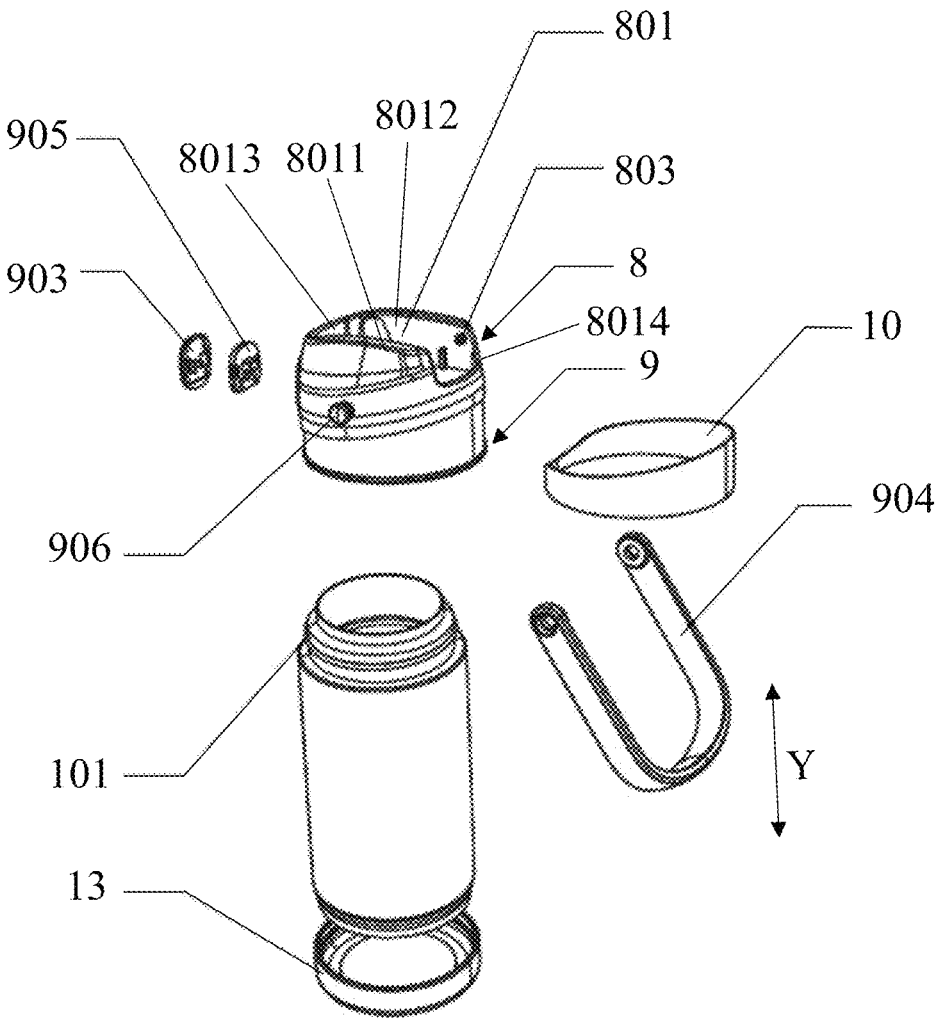
FIG. 8 is a structured diagram of a portion of a cup lid of a water cup with a detachable cup lid according to some embodiments of the present disclosure.
Figure 9:
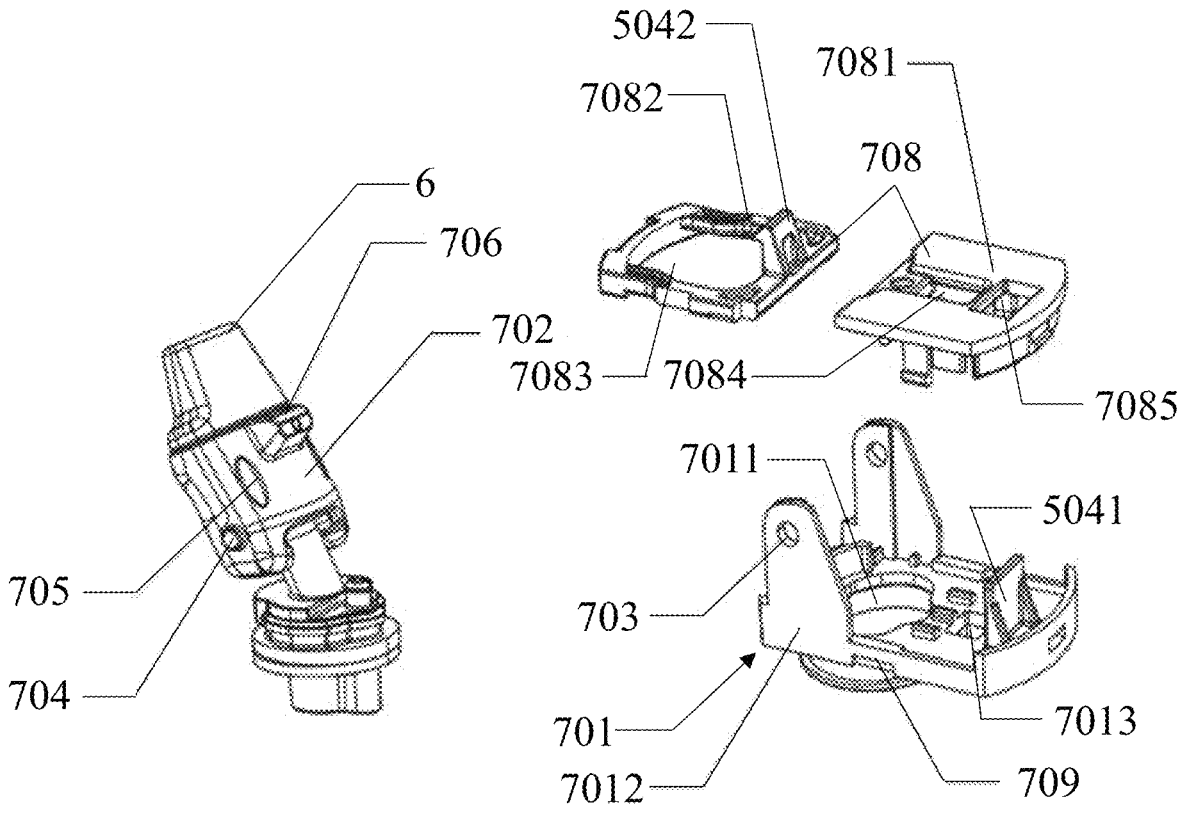
FIG. 9 is a structural diagram of a movable component of a water cup with a detachable cup lid according to some embodiments of the present disclosure.

FIG. 6 is a disassembled diagram of a structure of a cup lid of a water cup with a detachable cup lid according to some embodiments of the present disclosure. FIG. 7 is a side sectional view of a cup lid of a water cup with a detachable cup lid according to some embodiments of the present disclosure. FIG. 8 is a structured diagram of a portion of a cup lid of a water cup with a detachable cup lid according to some embodiments of the present disclosure. FIG. 9 is a structural diagram of a movable component of a water cup with a detachable cup lid according to some embodiments of the present disclosure.

In some embodiments, as shown in FIG. 1 to FIG. 2, and FIG. 6 to FIG. 9, the movable component 7 includes a P-type fixing bracket 701 and a movable block 702. The P-type fixing bracket 701 is disposed between the first straw through-hole 501 and the two first grooves 502. The movable block 702 is cooperatively connected with the P-type fixing bracket 701, and the movable block 702 is disposed with the straw mouthpiece 6.

The movable block 702 refers to a component that connects the straw mouthpiece 6 with the P-type fixing bracket 701, so that the straw mouthpiece 6 can move relative to the P-type fixing bracket 701. When the movable block 702 is cooperatively connected with the P-type fixing bracket 701, the movable block 702 can be moved relative to the P-type fixing bracket 701 under the control of the user, and drives the straw mouthpiece 6 to move relative to the P-type fixing bracket 701.

The P-type fixing bracket 701 refers to a component that constrains the motion trajectory of the movable block 702. Under the constraints of the P-type fixing bracket 701, the movable block 702 may only move in a particular manner (e.g., the movable block 702 can rotate). The P-type fixing bracket 701 may be understood as a fixing bracket whose projected shape along a particular direction is approximately the letter "P." For example, as shown in FIG. 1, in a direction perpendicular to a plane in which a length direction of the P-type fixing bracket 701 and the height direction of the water cup 100 are located, the projected shape of the P-type fixing bracket 701 is substantially the letter "P." The length direction of the P-type fixing bracket 701 may be indicated by the arrow X shown in FIG. 1 and FIG. 6.

A projection of the P-type fixing bracket 701 along the height direction of the water cup 100 is noted as a first projection. A projection of the first groove 502 along the height direction of the water cup 100 is noted as a second projection. A projection of the first straw through-hole 501 along the height direction of the water cup 100 is noted as a third projection. The P-type fixing bracket 701 being disposed between the first straw through-hole 501 and the first groove 502 refers that the first projection is located between the second projection and the third projection. Since the P-type fixing bracket 701 is disposed between the first straw through-hole 501 and the first groove 502, the P-type fixing bracket 701 can be mounted on the base 5 without affecting the fit between the first protrusion 901 and the first groove 502.

In some embodiments, the P-type fixing bracket 701 is transversely disposed on the base 5. The P-type fixing bracket 701 is provided with a second straw through-hole 7011 matching the first straw through-hole 501. The P-type fixing bracket 701 includes two mounting brackets 7012 symmetrically arranged along and with respect to a side wall of the second straw through-hole 7011, a top of each of the two mounting brackets 7012 is provided with openings 703. The movable block 702 is disposed between the two mounting brackets 7012, two sides of the movable block 702 are symmetrically provided with engaging members 704, and the openings 703 are engaged and connected with the engaging members 704.

The P-type fixing bracket 701 being transversely provided on the base 5 refers that the P-type fixing bracket 701 is provided on the base 5 in a direction parallel to a plane where a mouth of the cup body 1 is located. The length direction of the P-type fixing bracket 701 is perpendicular to the height direction of the cup body 1. FIG. 6 shows an example of the P-type fixing bracket 701 being transversely provided on the base 5.

The second straw through-hole 7011 is engaged with the first straw through-hole 501, which means that the second straw through-hole 7011 at least partially overlaps with the first straw through-hole 501 along the height direction of the cup body 1. When the P-type fixing bracket 701 is mounted on the base 5, the second straw through-hole 7011 at least partially overlaps with the first straw through-hole 501. The straw 14 can pass through the first straw through-hole 501 and the second straw through-hole 7011 to be in fluid connection with the straw mouthpiece 6 (e.g., the straw 14 is in fluid connection with the straw mouthpiece 6 via the connecting tube 11 hereinafter) and the interior of the cup body 1.

The mounting bracket 7012 refers to a component of the P-type fixing bracket 701 for fixing the movable block 702. The two mounting brackets 7012 are arranged along the side wall of the second straw through-hole 7011 and are symmetrical with respect to a center of the second straw through-hole 7011. The openings 703 of the two mounting brackets 7012 are coaxially provided (i.e., two center axes of the two openings 703 overlap). When the two engaging members 704 of the movable block 702 are engaged and connected with the two openings 703, the movable block 702 can rotate relative to the P-type fixing bracket 701 along the center axis of the opening 703.

In this embodiment, by respectively providing the engaging members 704 and the openings 703 on the movable block 702 and the mounting brackets 7012 of the P-type fixing brackets 701, the movable block 702 can rotate relative to the P-type fixing bracket 701 along the opening 703, thereby driving the straw mouthpiece 6 to rotate relative to the P-type fixing bracket 701. In addition, by providing the movable block 702, the user can control the rotation of the straw mouthpiece 6 without touching the straw mouthpiece 6, thus effectively preventing the straw mouthpiece 6 from being contaminated.

In some embodiments, as shown in FIG. 1 to FIG. 2, and FIG. 6 to FIG. 9, the movable block 702 is provided with a through-hole 707 internally, and a connecting tube 11 is provided in the through-hole 707. One end of the connecting tube 11 is nested and connected with the straw mouthpiece 6, the other end of the connecting tube 11 is nested and connected to one end of the straw 14, and the other end of the straw 14 passes through the second straw through-hole 7011 and the first straw through-hole 501 in sequence, and finally extends into an interior of the cavity of the cup body 1.

The nested connection refers that a structure (e.g., a tube structure) is inserted into an inner cavity of another structure (e.g., another tube structure), so that the inner cavities of the two structures are in fluid communication/connection. In this embodiment, an end of the connecting tube 11 is inserted into an inner cavity of the straw mouthpiece 6 to be in fluid connection with the inner cavity of the straw mouthpiece 6. The other end of the connecting tube 11 is inserted into an inner cavity of the straw 14 to be in fluid connection with the inner cavity of the straw 14. The straw mouthpiece 6, the connecting tube 11, and the straw 14 together form the drinking channel.

In this embodiment, by providing the connecting tube 11 in the movable block 702 to connect the straw mouthpiece 6 to the straw 14, a quickly detachable drinking channel can be formed, solving the problem that the blind corner of the straw 14 is difficult to clean. In addition, the nested connection manner can be convenient for the user to disassemble by hand, and significantly improve the cleaning convenience.

In some embodiments, as shown in FIG. 1 to FIG. 2, and FIG. 6 to FIG. 9, the water cup 100 further includes a bridge-type structure 503, two push plates 504, and the U-shaped cover 7081. The bridge-type structure 503 and the push plates 504 are set on the base 5. The bridge-type structure 503 is disposed between the two mounting brackets 7012. The two push plates 504 are symmetrically provided on both sides of the bridge-type structure 503. The U-shaped cover 7081 is stuck at one end of the P-type fixing bracket 701.

The bridge-type structure 503 refers to an arch-shaped support member set on the base 5. In some embodiments, the bridge-type structure 503 may cooperate with a second protrusion 706 provided on the movable block 702 as described below for separating the base 5 from the movable component 7 when disassembling the cup lid 2.

The push plate 504 refers to a plate-shaped structure vertically disposed on the base 5. After the drinking component 3 and the dustproof component 4 are assembled, the user can control the relative movement of the two push plates 504 through the switching member 9 to open the cup lid 2.

It should be noted that, although the bridge-type structure 503 and the push plates 504 are described as being set on the base 5 in some embodiments, the bridge-type structure 503 and the push plates 504 are not necessarily directly connected to the base 5, but are supported by the base 5. For example, the bridge-type structure 503 may be directly connected to the base 5, while the two push plates 504 may be set on other structures (e.g., a first push plate 5041 and a second push plate 5042 below are set on the P-type fixing bracket 701 and a first fixing plate 708, respectively). When the dustproof component 4 is assembled with the drinking component 3, the P-type fixing bracket 701 and the first fixing plate 708 are mounted on the base 5, and the two push plates 504 are indirectly connected with the base 5. As another example, the two push plates 504 may be directly connected to the base 5, while the bridge-type structure 503 may be set on other structures. When the dustproof component 4 is assembled with the drinking component 3, the bridge-type structure 503 is indirectly connected with the base 5. The bridge-type structure 503 and the two push plates 504 may be specifically described below.

In some embodiments, as shown in FIG. 1 to FIG. 2, and FIG. 6 to FIG. 9, the base 5 is also provided with a bridge-type structure 503, a first push plate 5041, and a second push plate 5042. The P-type fixing bracket 701 further includes a first mounting hole 7013 adapted to the bridge-type structure 503, and the first push plate 5041 is provided on a side of the first mounting hole 7013 away from the second straw through-hole 7011. The movable component 7 further includes the first fixing plate 708. The first fixing plate 708 includes a third straw through-hole 7083, a second mounting hole 7084, and a third mounting hole 7085. The third straw through-hole 7083 is adapted to the first straw through-hole 501 and the second straw through-hole 7011. The second mounting hole 7084 is adapted to the bridge-type structure 503, and the second push plate 5042 is disposed within the second mounting hole 7084. The third mounting hole 7085 is adapted to the first push plate 5041. When the base 5, the P-type fixing brackets 701, and the first fixing plate 708 are mounted in sequence from bottom to top along the height direction of the water cup 100, at least a portion of the bridge-type structure 503 passes through the first mounting holes 7013 and the second mounting holes 7084 in sequence. At least a portion of the first push plate 5041 passes through the third mounting hole 7085, so that the first push plate 5041 and the second push plate 5042 are disposed symmetrically with respect to the bridge-type structure 503.

The first fixing plate 708 refers to a plate-shaped structure mounted on the top of the P-type fixing bracket 701 and used to link the switching member 9 for opening and closing the cup lid 2. The first mounting hole 7013 refers to a through-hole for allowing the bridge-type structure 503 to pass through the P-type fixing bracket 701. The second mounting hole 7084 refers to a through-hole for allowing the bridge-type structure 503 to pass through the first fixing plate 708. The third mounting hole 7085 refers to a through-hole for allowing the first push plate 5041 to pass through the first fixing plate 708. When the base 5, the P-type fixing bracket 701, and the first fixing bracket 708 are mounted in sequence from bottom to top along the height direction of the water cup 100, at least a portion of the bridge-type structure 503 passes through the first mounting hole 7013 and the second mounting hole 7084 in sequence and protrudes from an upper surface of the first fixing plate 708. At least a portion of the first push plate 5041 passes through the third mounting holes 7085 and protrudes from the upper surface of the first fixing plate 708, so that the first push plate 5041 and the second push plate 5042 are symmetrically disposed relative to the bridge-type structure 503.

The first push plate 5041 and the second push plate 5042 are equivalent to different push plates 504 in other embodiments of the present disclosure. The first push plate 5041 and the second push plate 5042 being symmetrically disposed with respect to the bridge-type structure 503 refers that the overall positions of the first push plate 5041 and the second push plate 5042 are symmetrical with respect to the bridge-type structure 503. For example, referring to FIG. 6 to FIG. 7, the push plate 504 disposed between the movable block 702 and the bridge-type structure 503 is the first push plate 5041, the push plate 504 disposed on a side of the bridge-type structure 503 away from the movable block 702 is the second push plate 5042. It should be understood that the structures of the first push plate 5041 and the second push plate 5042 may be the same or different.

In some embodiments, referring to FIG. 9, the first fixing plate 708 includes a U-shaped cover 7081 and an annular cover 7082 that is detachably connected to the U-shaped cover 7081. The second mounting holes 7084 and the third mounting holes 7085 are provided on the U-shaped cover 7081. The third straw through-hole 7083 is provided on the annular cover 7082, and the second push plate 5042 is provided on an upper surface of the annular cover 7082.

In this embodiment, the assembly of the first fixing plate 708 can be realized by the cooperation between the second mounting hole 7084 and the second push plate 5042. For example, when assembling the first fixing plate 708, the second push plate 5042 can be inserted into the second mounting hole 7084 from below the U-shaped cover 7081.

In this embodiment, by designing the first fixing plate 708 to be detachable, the detachable range of the cup lid 2 can be increased, making cleaning more convenient and preventing the growth of bacteria and dirt.

In some embodiments, a second groove 705 and a second protrusion 706 are provided on one side of the movable block 702 close to an end of the P-type fixing bracket 701. The end of the P-type fixing bracket 701 refers to an end of the P-type fixing bracket 701 along the length direction of the P-type fixing bracket 701 where the first push plate 5041 is disposed.

In some embodiments, the second protrusion 706 is configured so that when the cup lid 2 is in the closed state (as shown in FIG. 4), the second protrusion 706 is maintained between the two push plates 504 (for example, the first push plate 5041 and the second push plate 5042). In some embodiments, the second protrusion 706 is configured so that when the cup lid 2 is in the closed state and the movable block 702 is pressed, the second protrusion 706 abuts against the bridge-type structure 503, and the force generated by the abutment between the second protrusion 706 and the bridge-type structure 503 separates the base 5 from the movable component 7. More descriptions regarding the second protrusion 706 may be found in the related descriptions below.

In some embodiments, the material of the straw mouthpiece 6 may include at least one of silicone, thermoplastic elastomer, polypropylene, or the like. In some embodiments, the material of the base 5 may include at least one of silicone, acrylonitrile butadiene styrene (ABS) plastic, polyphenylsulfone, or the like. In some embodiments, the material of the straw mouthpiece 6 and the material of the base 5 may be the same or different. For example, the material of the straw mouthpiece 6 and the material of the base 5 may both be silicone.

In this embodiment, the straw mouthpiece 6 and the base 5 made of silicone material are resistant to bacterial attachment and mold growth. Combined with a detachable design, it can improve the cleaning effect and effectively solve the problem of bacterial buildup. In addition, the straw mouthpiece 6 made of silicone material can also avoid the discomfort caused by the lip of the user contacting hard materials (e.g., plastic/metal) when drinking water. At the same time, when the cup lid 2 is opened, the straw mouthpiece 6 made of silicone material can absorb a portion of the impact force, reducing noise and protecting the internal mechanical structure.

Figure 10:
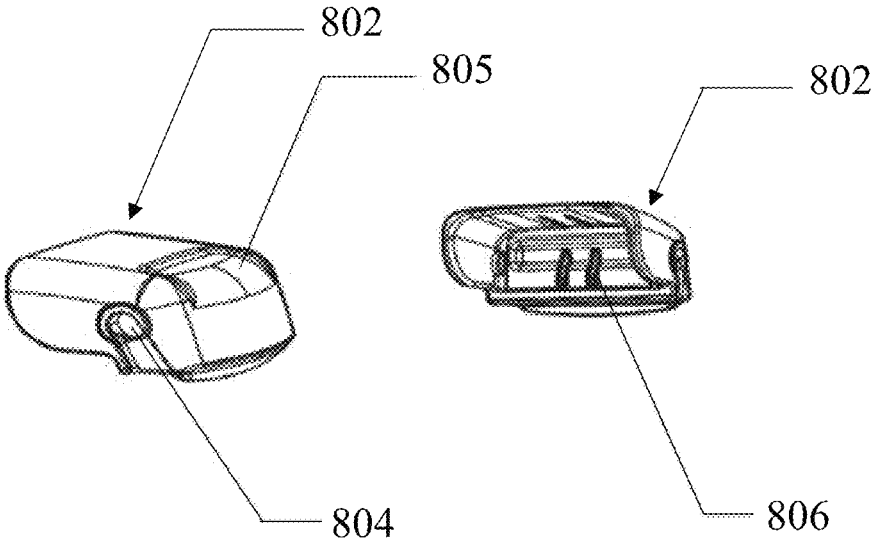
FIG. 10 is a structural diagram of a protective cover of a water cup with a detachable cup lid according to some embodiments of the present disclosure.

FIG. 10 is a structural diagram of a protective cover of a water cup with a detachable cup lid according to some embodiments of the present disclosure.

In some embodiments, as shown in FIG. 1, FIG. 4 to FIG. 5, FIG. 7, and FIG. 9 to FIG. 10, the switching member 9 is provided with a key switch 903. The key switch 903 is slidably connected to the switching member 9 via a sliding plate 905 provided in the switching member 9. When the key switch 903 slides to a locking position, relative positions of the first push plate 5041 and the second push plate 5042 are locked. When the key switch 903 slides to an unlocking position, the key switch 903 can push the second push plate 5042 to approach the first push plate 5041.

The sliding plate 905 refers to a guide rail for the key switch 903 to slide. An extending direction of the sliding plate 905 is parallel to the height direction of the water cup 100. A sliding pair is provided between the sliding plate 905 and the key switch 903, so that the key switch 903 can slide relative to the sliding plate 905.

Merely by way of example, a locking hole 9051 is provided at an upper end of the sliding plate 905, and an elastic protrusion 9031 is provided on a side of the key switch 903 close to the sliding plate 905. After the cup lid 2 is assembled, the first fixing plate 708 (e.g., the annular cover 7082 of the first fixing plate 708) is disposed at one end of the locking hole 9051. When the key switch 903 slides to the upper end of the sliding plate 905 to cause the elastic protrusion 9031 to align with the locking hole 9051, it indicates that the key switch 903 has slid to the unlocking position. When the key switch 903 is located at the unlocking position and is pressed, the elastic protrusion 9031 extends into the locking hole 9051 and abuts against a side wall of the annular cover 7082, thereby pushing the second push plate 5042 to move toward the first push plate 5041. When the second push plate 5042 moves to squeeze the second protrusion 706, so that the second protrusion 706 moves out from the two push plates 504, at this time, the straw mouthpiece 6 is ejected by the elastic force of the silicone, and the cup lid 2 is opened.

On the contrary, when the key switch 903 slides to a lower end of the sliding plate 905, the elastic protrusion 9031 disengages from the locking hole 9051. At this time, the second push plate 5042 is not affected by the key switch 903, the relative position of the second push plate 5042 and the first push plate 5041 is fixed. The second protrusion 706 is maintained between the two push plates 504, and the cup lid 2 is in the closed state.

In some embodiments, as shown in FIG. 1 to FIG. 3 and FIG. 6, two third protrusions 902 are symmetrically provided on the inner side of the switching member 9, and the two third protrusions 902 are provided on an inner side of the two first protrusions 901. The P-type fixing bracket 701 is symmetrically provided with two third grooves 709. The switching member 9 is engaged and connected with the P-type fixing bracket 701 via the two third protrusions 902 and the two third grooves 709. The key switch 903 and a carrying handle 904 are provided on an outer side wall of the switching member 9. The key switch 903 is slidably connected to the switching member 9 via the sliding plate 905 provided on the outer side wall of the switching member 9. The carrying handle 904 is fixedly connected to the switching member 9 via screws 906 symmetrically provided on the outer side wall of the switching member 9.

Similar to the first protrusion 901, the two third protrusions 902 are disposed on the inner side wall of the switching member 9 and are symmetrical with respect to the center axis of the switching member 9. The two third protrusions 902 being provided on the inner side of the two first protrusions 901 refers that a distance between the two third protrusions 902 is less than a distance between the two first protrusions 901. For example, the two third protrusions 902 are respectively connected to different first protrusions 901, and the third protrusions 902 are located on a side of the first protrusion 901 close to the central axis of the switching member 9. In this embodiment, since the P-type fixing bracket 701 is located between the two first grooves 502 and the first straw through-hole 501, the two first grooves 502 and the two third grooves 709 do not interfere with each other, and the two first protrusions 901 and the two third protrusions 902 do not interfere with each other, so that the switching member 9 is connected to the P-type fixing bracket 701.

In this embodiment, the carrying handle 904 is rotatably connected to the switching member 9 via the screw 906, so that the user can conveniently lift and carry the water cup 100.

In some embodiments, as shown in FIG. 1 to FIG. 5 and FIG. 8 to FIG. 10, the fixing member 8 includes a U-shaped shell 801 and a protective cover 802 rotationally connected to the U-shaped shell 801. A first inner side wall 8011 and a second inner side wall 8012 of the U-shaped shell 801 are each provided with a fourth protrusion 803. The fourth protrusions 803 on the first inner side wall 8011 and the second inner side wall 8012 are both symmetrically disposed, and are provided close to a lateral opening 8014 of the U-shaped shell 801. Two fourth grooves 804 are symmetrically provided on both sides of the protective cover 802, and the protective cover 802 is engaged and connected to the U-shaped shell 801 via the two fourth grooves 804 and the fourth protrusions 803. The two fourth grooves 804 are provided with rolling bearings 805, and the rolling bearings 805 are fixedly connected with the fourth protrusions 803. A lap buckle 806 is vertically disposed on an end of the protective cover 802.

The U-shaped shell 801 refers to a shell that is roughly shaped like the letter "U" in the cross-section perpendicular to the height direction of the water cup 100. An inner wall of the U-shaped shell 801 forms an accommodation cavity 8015 for accommodating the straw mouthpiece 6 and the protective cover 802. The inner wall of the U-shaped shell 801 includes the first inner side wall 8011 and the second inner side wall 8012 symmetrically arranged. One end of the first inner side wall 8011 and one end of the second inner side wall 8012 are connected via a third inner side wall 8013, and the other end of the first inner side wall 8011 and the other end of the second inner side wall 8012 are provided with an opening, i.e., the lateral opening 8014 of the U-shaped shell 801.

The protective cover 802 refers to a component that protects the straw mouthpiece 6 and prevents the straw mouthpiece 6 from being contaminated when the cup lid 2 is closed. For example, as shown in FIG. 5, when the cup lid 2 is assembled and the cup lid 2 is opened, the straw mouthpiece 6 extends out from the top of the U-shaped shell 801 through the accommodation cavity 8015 to realize the drinking function. At the same time, an open end of the protective cover 802 also extends out from the U-shaped shell 801. As shown in FIG. 4, when the cup lid 2 is closed, the entire straw mouthpiece 6 is in the accommodation cavity 8015, and the top of the straw mouthpiece 6 is inserted into the protective cover 802, thereby protecting the straw mouthpiece 6 from dust via the protective cover 802.

The lap buckle 806 refers to a component provided inside the protective cover 802 for limiting the relative movement between the protective cover 802 and the straw mouthpiece 6. When the user presses the movable block 702, the movable block 702 drives the straw mouthpiece 6 to move toward the accommodation cavity 8015. During the movement of the straw mouthpiece 6, the top of the straw mouthpiece 6 is inserted into the interior of the protective cover 802 from the open end of the protective cover 802 and abuts against the lap buckle 806. If the straw mouthpiece 6 continues to move toward the accommodation cavity 8015, the straw mouthpiece 6 may drive the protective cover 802 to rotate together, and finally the straw mouthpiece 6 and the protective cover 802 are stored into the accommodation cavity 8015 together, and the cup lid 2 is closed.

The two fourth grooves 804 are engaged and connected to the two fourth protrusions 803 via the rolling bearings 805, so that the protective cover 802 can be rotated relative to the U-shaped shell 801. For example, the rolling bearing 805 is configured to be disposed in the fourth groove 804 and rotate relative to the fourth groove 804 along the axis direction of the rolling bearing, and the fourth protrusion 803 may be a fixed shaft adapted to the rolling bearing 805. Since the rolling bearing 805 is fixedly connected to the fourth protrusion 803, and the rolling bearing 805 can rotate relative to the fourth groove 804, the protective cover 802 can rotate relative to the U-shaped shell 801.

In some embodiments, the material of the cup body 1 includes at least one of stainless steel, titanium, plastic, or the like. The material of the dustproof cover 10 includes at least one of silicone, thermoplastic elastomer, or the like. Merely by way of example, the material of the cup body 1 may be stainless steel, and the material of the dustproof cover 10 may be silicone.

In some embodiments, as shown in FIG. 1, and FIG. 7 to FIG. 8, the dustproof cover 10 is nested and connected with the cup lid 2. For example, the shape of the dustproof cover 10 is adapted to an outer contour of the switching member 9, so that the dustproof cover 10 can be sleeved on the outer side wall of the switching member 9.

In some embodiments, the cup lid 2 is nested and connected with the cup body 1, the mouth of the cup body 1 is provided with external threads 101, the inner wall of the switching member 9 is provided with internal threads 12 that match the outer threads 101, and the cup body 1 and the cup lid are detachably connected through the external threads 101 and the internal threads 12.

In some embodiments, a silicone protective layer 13 is provided at a bottom of the cup body 1, and the silicone protective layer 13 is socketed to an outside of the bottom of the cup body 1. In this embodiment, by providing the silicone protective layer 13 at the bottom of the cup body 1, the impact force when the water cup 100 falls or collides can be effectively absorbed, preventing the cup body 1 from directly contacting hard objects and causing deformation, breakage or surface scratches. In addition, the silicone protective layer 13 can prevent the water cup 100 from sliding or tipping on a smooth surface, and reduce the wear caused by friction between the cup body 1 and the desktop.

This disclosure provides an exemplary embodiment of a water cup with a detachable cup lid.

In this embodiment, the cup lid 2 is opened in a pop-up manner, and the cup lid 2 can be disassembled into a plurality of components.

The user may control the key switch 903 to slide on the sliding plate 905. When the user controls the key switch 903 to slide downward to the locking position, the relative positions of the first push plate 5041 and the second push plate 5042 are locked, and the cup lid 2 is locked, as shown in FIG. 9.

When the user controls the key switch 903 to slide upward to the unlocking position, the second push plate 5042 is moved relative to the first push plate 5041 to prepare for the cup lid 2 to be opened in the pop-up manner. When the user presses the key switch 903, the key switch 903 can push the first fixing plate 708 (e.g., the annular cover 7082 of the first fixing plate 708) to move relative to the P-type fixing bracket 701, thereby driving the second push plate 5042 to move toward the first push plate 5041. When the second push plate 5042 moves toward the first push plate 5041, the second push plate 5042 squeezes the second protrusion 706, so that the second protrusion 706 moves out from the first push plate 5041 and the second push plate 5042. At this time, the silicone straw mouthpiece 6 pops out from the accommodation cavity 8015 of the U-shaped shell 801 under the action of elastic force (as shown in FIG. 5), so that the cup lid 2 is opened.

When disassembling the cup lid 2, the user can hold the base 5 and the switching member 9 respectively to separate the two first grooves 502 and the two first protrusions 901. At the same time, the user presses a side of the movable block 702 opposite to the second protrusion 706 to make the second protrusion 706 abut against the bridge-type structure 503, thereby separating the drinking component 3, the movable component 7, and the dustproof component 4 through the action force between the second protrusion 706 and the bridge-type structure 503. When the drinking component 3, the movable component 7, and the dustproof component 4 are separated, the protective cover 802 can rotate along the rolling bearings 805. When the protective cover 802 rotates to abut against the U-shaped shell 801, the rotation of the protective cover 802 may be restricted.

When the user closes the cup lid 2, the user can directly press the movable block 702 to rotate the movable block 702 and the straw mouthpiece 6 relative to the P-type fixing bracket 701, so that the second protrusion 706 can be inserted between the first push plate 5041 and the second push plate 5042. At the same time, the top of the straw mouthpiece 6 extends into the protective cover 802 and touches the lap buckle 806, thereby driving the protective cover 802 by the straw mouthpiece 6 to rotate and store in the accommodation cavity 8015 of the U-shaped shell 801. When the cup lid 2 is closed, the protective cover 802 can prevent external pollutants such as dust and flying insects from entering the straw mouthpiece 6, ensuring the hygiene of drinking water.

When the user opens the cup lid 2, the user only needs to press the key switch 903 to push the second push plate 5042 to approach the first push plate 5041, thereby squeezing the second protrusion 706 to disengage. Subsequently, the straw mouthpiece 6 automatically pops out due to the elastic force of the silicone, and the cup lid 2 is opened.

Lastly, it should be noted that the above embodiments are only used to illustrate the technical solutions of one or more embodiments of the present disclosure rather than limiting them, and although the disclosure has been described in detail with reference to the preferred embodiments, those skilled in the art should understand that it is still possible to make modifications or equivalent replacements to the technical solutions of the present disclosure, and these modifications or equivalent replacements do not depart from the spirit and scope of the technical solutions of the present disclosure.

What is claimed is:

1. A water cup, comprising a cup body and a cup lid detachably connected to the cup body; wherein the cup lid includes a drinking component and a dustproof component;

the drinking component includes a base and a straw mouthpiece, the base is provided with a first straw through-hole, the straw mouthpiece is connected to the base via a movable component, the base is further provided with two first grooves, the two first grooves are symmetrically arranged along and with respect to the first straw through-hole;

the dustproof component includes a fixing member, a switching member, and a dustproof cover arranged in sequence from top to bottom along a height direction of the water cup, an inner side of the switching member is symmetrically provided with two first protrusions, the switching member is connected to the base via the two first protrusions and the two first grooves, wherein the fixing member stores the straw mouthpiece and prevents the straw mouthpiece from being contaminated when the cup lid is closed;

the fixing member includes a U-shaped shell and a protective cover rotationally connected to the U-shaped shell; and the switching member allows a user to open or close the cup lid;

when the two first protrusions are engaged with the two first grooves, the drinking component is fixed with the dustproof component; and when the two first protrusions are disengaged from the two first grooves, the drinking component is detached from the dustproof component.

2. The water cup according to claim 1, wherein the movable component includes a P-type fixing bracket and a movable block, the P-type fixing bracket is disposed between the first straw through-hole and the two first grooves, the movable block is cooperatively connected with the P-type fixing bracket, and the movable block is disposed with the straw mouthpiece, wherein the P-type fixing bracket is a fixing bracket whose projected shape along a particular direction is approximately the letter "P".

3. The water cup according to claim 2, wherein the P-type fixing bracket is transversely disposed on the base, the P-type fixing bracket is provided with a second straw through-hole cooperating with the first straw through-hole, the P-type fixing bracket includes two mounting brackets symmetrically arranged along and with respect to a side wall of the second straw through-hole, and a top of each of the two mounting brackets is provided with openings; and the movable block is disposed between the two mounting brackets, two sides of the movable block are symmetrically provided with engaging members, and the openings are engaged and connected with the engaging members.

4. The water cup according to claim 3, wherein a second groove and a second protrusion are provided on one side of the movable block close to an end of the P-type fixing bracket, and the second groove is different from the two first grooves.

5. The water cup according to claim 3, wherein the movable block is provided with a through-hole internally, a connecting tube is provided in the through-hole, one end of the connecting tube is nested and connected with the straw mouthpiece, the other end of the connecting tube is nested and connected with one end of a straw, and the other end of the straw sequentially passes through the second straw through-hole and the first straw through-hole to an interior of a cavity of the cup body.

6. The water cup according to claim 3, wherein materials of both the straw mouthpiece and the base include silicone.

7. The water cup according to claim 3, further comprising: a bridge-type structure, two push plates, and a U-shaped cover, wherein the bridge-type structure and the two push plates are set on the base, the bridge-type structure is disposed between the two mounting brackets, the two push plates are symmetrically provided on both sides of the bridge-type structure, and the U-shaped cover is stuck at an end of the P-type fixing bracket.

8. The water cup according to claim 7, wherein a first inner side wall and a second inner side wall of the U-shaped shell are each provided with a fourth protrusion, the fourth protrusions on the first inner side wall and the second inner side wall are both provided close to and symmetrically disposed with respect to a lateral opening of the U-shaped shell;

two fourth grooves are symmetrically provided on both sides of the protective cover, the two fourth grooves are engaged and connected to the fourth protrusions;

both the two fourth grooves are provided with rolling bearings, the rolling bearings are fixedly connected with the fourth protrusions; and a lap buckle is vertically provided inside the protective cover.

9. The water cup according to claim 3, wherein the base is further provided with a bridge-type structure, a first push plate, and a second push plate; wherein the P-type fixing bracket further includes a first mounting hole adapted to the bridge-type structure, the first push plate is provided on a side of the first mounting hole away from the second straw through-hole;

the movable component further includes a first fixing bracket, the first fixing bracket includes a third straw through-hole adapted to the first straw through-hole and the second straw through-hole, a second mounting hole adapted to the bridge-type structure, and a third mounting hole adapted to the first push plate, the second push plate is disposed within the second mounting hole; and when the base, the P-type fixing bracket, and the first fixing bracket are mounted in sequence from bottom to top along the height direction of the water cup, at least a portion of the bridge-type structure sequentially passes through the first mounting hole and the second mounting hole, at least a portion of the first push plate passes through the third mounting hole, and the first push plate and the second push plate are symmetrically disposed with respect to the bridge-type structure.

10. The water cup according to claim 9, wherein the switching member is provided with a key switch, the key switch is slidably connected to the switching member via a sliding plate provided in the switching member, when the key switch slides to a locking position, relative positions of the first push plate and the second push plate are locked, and when the key switch slides to an unlocking position, the key switch is capable of pushing the second push plate to approach the first push plate.

11. The water cup according to claim 3, wherein two third protrusions are symmetrically provided on an inner side of the switching member, the two third protrusions are provided on an inner side of the two first protrusions, the P-type fixing bracket is symmetrically provided with two third grooves, the switching member are engaged and connected with the P-type fixing bracket via the two third grooves and the two third protrusions;

a key switch and a carrying handle are provided on an outer side wall of the switching member, the key switch is slidably connected to the switching member via a sliding plate provided on the outer side wall of the switching member; and the carrying handle is fixedly connected with the switching member via screws symmetrically provided on the outer side wall of the switching member.

12. The water cup according to claim 1, wherein a material of the cup body includes stainless steel, and a material of the dustproof cover includes silicone.

13. The water cup according to claim 1, wherein the cup lid is nested and connected with the cup body, a mouth of the cup body is provided with external threads, an inner wall of the switching member is provided with internal threads that match the external threads, and the cup body and the cup lid are detachably connected through the external threads and the internal threads.

14. The water cup according to claim 1, wherein a silicone protective layer is provided at a bottom of the cup body, and the silicone protective layer is socketed to an outside of the bottom of the cup body.

* * * * *